SR
OR 3,988,726

United Sta
Reiss et al.

[11] 3,988,726
[45] Oct. 26, 1976

[54] INFRARED INTRUSION DETECTION APPARATUS

[75] Inventors: Martin H. Reiss, Newton; Elias E. Solomon, Duxbury, both of Mass.

[73] Assignee: Gulf & Western Manufacturing Company, New York, N.Y.

[22] Filed: Mar. 17, 1975

[21] Appl. No.: 558,636

Related U.S. Application Data

[62] Division of Ser. No. 394,065, Sept. 4, 1973, Pat. No. 3,886,360.

[52] U.S. Cl. ..... 340/258 D; 250/338
[51] Int. Cl.[2] ..... G08B 13/18
[58] Field of Search ..... 340/258 R, 258 D, 228 R; 250/340, 338

[56] References Cited

UNITED STATES PATENTS

| | | | |
|---|---|---|---|
| 3,299,416 | 1/1967 | Koppel | 340/228 R |
| 3,509,359 | 4/1970 | Embling | 340/258 B |
| 3,680,068 | 7/1972 | Hanchett | 340/228 R |
| 3,703,718 | 11/1972 | Berman | 340/258 D |
| 3,760,399 | 9/1973 | Schwarz | 340/258 D |

*Primary Examiner*—Glen R. Swann III
*Attorney, Agent, or Firm*—Wolf, Greenfield & Sacks

[57] ABSTRACT

The infrared system employs an optical focusing arrangement for collecting radiation from a moving object such as an intruder and directing the energy to a sensing element which may be a thermistor whose resistance changes with energy level change. The detection circuit comprises a biasing means comprising a voltage divider network in series with the sensing element and a modulator or oscillator circuit coupled to the sensing element. The modulated output signal from the sensing element couples to an impedance matching circuit which in turn couples to an amplifier. The output from the amplifier couples to a low frequency blocking filter for removing very low frequency components of the signal. From there the signal couples to an integrator and an output trigger alarm circuit. When sufficient energy is received by the sensing element the amplifier saturates and the modulating frequency disappears or is shunted. Once this occurs the trigger circuit is activated and an alarm condition prevails. Alternatively, when the sensing element is not receiving energy the trigger circuit is prevented from operating the alarm.

17 Claims, 9 Drawing Figures

PRIOR ART

INFRARED INTRUSION DETECTION APPARATUS

This is a division of application Ser. No. 394,065, filed Sept. 4, 1973, now U.S. Pat. No. 3,886,360.

FIELD OF THE INVENTION

The present invention relates in general to an infrared intrusion detection system, and pertains more particularly, to an infrared system for detecting an intruder's motion and having an improved optical collecting system and improved detection and supervision circuitry.

BACKGROUND OF THE INVENTION

A typical prior art patent is U.S. Pat. No. 3,703,718 which discloses an optical collecting means for use in an infrared intrusion detector system. FIG. 1 of the present invention discloses a segmented spherical mirror system of the type disclosed in that patent.

Some of the previous problems associated with optical systems using detection of radiated energy, whether visible or invisible, stem from a physical limitation; that to achieve a sharp focus the mirror or lens system has to be of a relatively small size. Accordingly, known optical systems have a correspondingly small collecting area and generally only a small portion of the image can be utilized by a typical sensing element.

As an example of a system of the type disclosed in U.S. Pat. No. 3,703,718, consider an object, such as a person, having a length of two meters positioned at a distance of 10 meters from the detector. Assuming ideal focusing, the image is at or very near the focal point of the mirror. The image length is represented by the following equation:

$$I = V/U\ (X).$$

where I equals image size:

X = object size

U = distance of object from detector

V = distance of image.

Assuming that the distance V is equal to the focal length and that the focal point is at a distance of 10 centimeters (cm) then the image length is calculated as follows:

$$I = \frac{.10 \times 2\text{m}}{10} = 2\text{cm}.$$

Thus, in the above example the image has a length of approximately 2 centimeters. However, a typical sensor covers a length of only 0.2 centimeters and thus only about one-tenth of the image is available for generating a signal at the detector. Larger sensors can be constructed, but are impractical as they become excessively costly.

Another problem associated with using an optical system of the type disclosed in U.S. Pat. No. 3,703,718, is concerned with the orientation of the image with respect to the detector. The detectors are normally mounted in an enclosure as taught by that patent with a suitable window. As a result, and particularly because of the concave mirror system, not all of the radiation reaches the sensing element and thus the efficiency of the system is impaired.

However, in accordance with the present invention, primarily only parallel rays are collected and thus the image is sharply focused.

Other problems relating to these prior art infrared detection systems pertain in particular to the detection circuitry.

Difficulties arise when it is attempted to detect low level signals using detectors which have a comparatively high noise level. The sensors themselves are usually high impedance devices such as a thermistor. Impedance matching networks are therefore required and because of the low-level signal high gain amplifiers are also required. There is an attendant tendency in these circuits for a low frequency component to be present which at the output, constitutes a not negligible portion of the signal level. A typical system would use a filter network.

However, in accordance with the present invention and to reduce the need to filter this low-level frequency signal, and also to supervise the operation of the sensing element, a modulation technique is used which greatly simplifies the filtering operation and level detection of the signal.

Accordingly, one important object of the present invention is to provide an improved optical system for an infrared intrusion detection system and that is characterized by an increase in the amount of radiation that is collected.

A further object of the present invention is to an optical collecting system for gathering parallel rays from the object which are collected at a point focus.

Another object of the present invention is to provide an optical system in accordance with the preceding object and that is relatively simple in construction, easily constructed, readily adjustable, and can be manufactured at reasonable cost.

Another important object of the present invention is to provide improved detection and supervision circuitry for use in an infrared detection system.

SUMMARY OF THE INVENTION

In accordance with the present invention there is provided an optical system or apparatus for use in an infrared intrusion detection system and generally comprising a sensing element for receiving infrared radiation and generating an electrical signal corresponding thereto, a convex reflector surface, an array of plane mirrors and a collector reflector. The convex reflector surface receives the infrared radiation from objects in a field of view and has a defined principle axis. The rays reflected from the convex surface are parallel to this principle axis. The array of plane mirrors, which is formed as a one piece structure, is arranged in a single plane in front of the convex reflector surface. The plane defined by these plane mirrors is disposed nonorthogonally to the principal axis of the convex reflective surface. The collector reflector is for receiving radiation reflected from the plane mirrors and directing this radiation toward the sensing element. The array of plane mirrors in one embodiment comprised a 3 × 3 array for sectioning the field of view into essentially nine discreet spatial viewing areas.

In one embodiment the plane mirrors are of square configuration and in another embodiment they are of triangular configuration. In another optical arrangement disclosed herein, there is provided a series of plane mirrors disposed along an arcuate locus for directing radiated energy to a parabolic or concave collector having the sensing element disposed at the focus thereof. In still another arrangement a typical segmented spherical mirror is used but the sensing element is disposed asymmetrically so as to receive more radiation from one of the mirror segments collecting the radiation from the furthest point of detection in the field of view. In still a further arrangement, a series of spaced spherical mirrors are employed having varying focal lengths for providing improved collection of the radiated energy.

In accordance with the present invention there is also provided improved detection and supervisory circuitry. In accordance with this invention there is provided a relatively low frequency, for example around 15 hertz, signal which is coupled in series with the sensing element. The modulated signal is coupled by way of an impedance matching circuit and an amplifier circuit to a low frequency filter transformer circuit which is for removing low frequency noise below the modulating frequency. A trigger circuit is provided and is activated when the modulating signal disappears which in turn is caused by the detection of an intruder by the sensor. With this modulating technique the failure of a sensor is also immediately detected.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
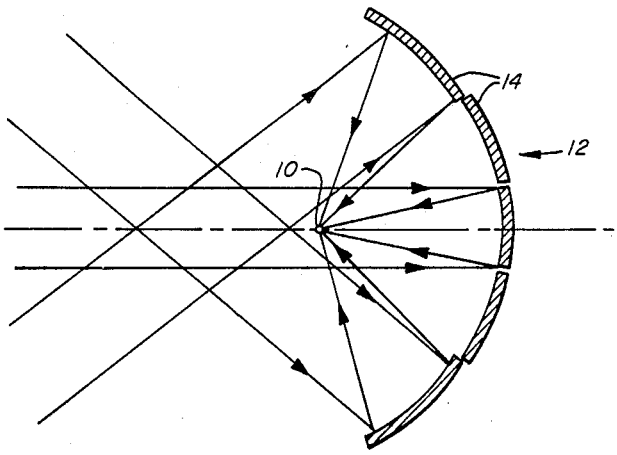
FIG. 1 shows a prior art optical collection apparatus for an infrared intrusion detection system.

As previously indicated, FIG. 1 shows a prior art optical collecting system for an infrared intrusion detection system, and of the type disclosed in U.S. Pat. No. 3,703,718. This system comprises a sensing element 10 and an optical means 12 which includes a plurality of spaced reflective members 14. This arrangement provides a number of spaced apart sector-shaped fields of view corresponding to the number of reflective members employed. When an intruder enters the secured area, each time he passes into or out of one of the discreet fields, the level of radiation in that field changes suddenly. These sudden changes are detected at the sensing element 10 which produces a corresponding electrical signal as discussed in more detail hereinafter.

Previously, the disadvantages associated with this system have been discussed in some detail.

Figure 2:
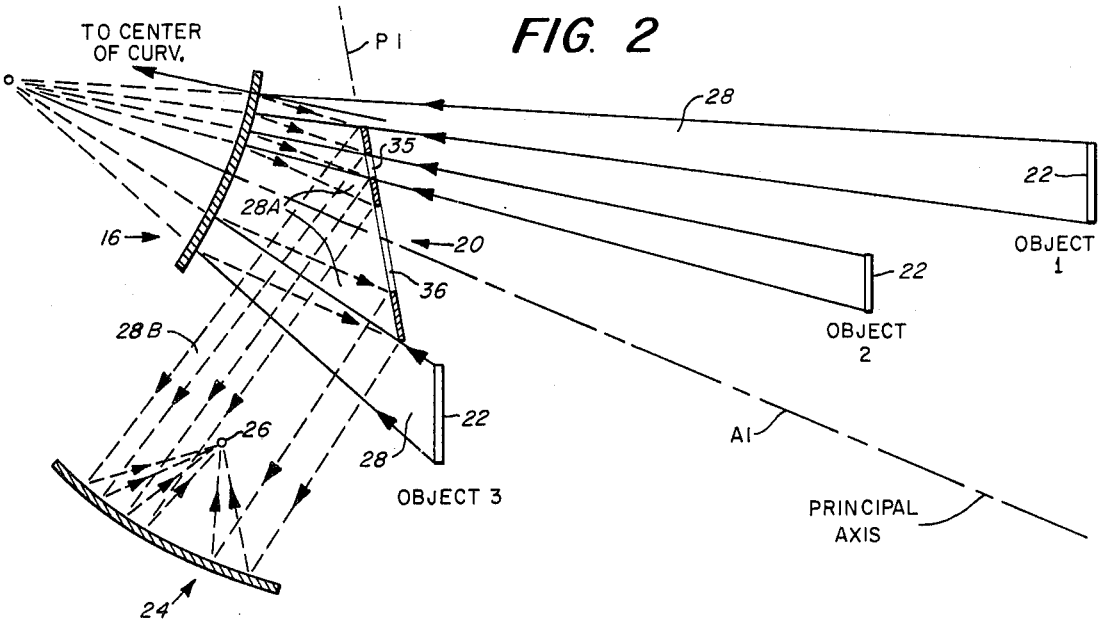
FIG. 2 is a partially cross-sectional view of an optical mirror system constructed in accordance with the principles of the present invention.

An improved optical system in accordance with the present invention is shown in FIG. 2. This system generally comprises a convex mirror 16, a plane mirror array 20, and a parabolic or concave collector mirror 24. A conventional sensing element 26 is disposed at the focal point of mirror 24. This sensing element may be a thermistor, thermopile, or a pyro-electric sensor.

The convex mirror 16 may be of the type having a silvered front or could be a stainless steel reflective mirror.

FIG. 2 also shows diagramatically an object 22 in three different positions at different distances from the optical system. The rays 28 emanating from the object are reflected from the reflective surface of mirror 16 toward plane mirror array 20. In FIG. 2 the plane mirror arrays is shown as extending along the direction of plane P1. FIG. 2 also shows the principle axis A1 associated with convex reflector 16. The plane P1 is disposed non-orthorgonally to the principal axis A1.

Figure 3:
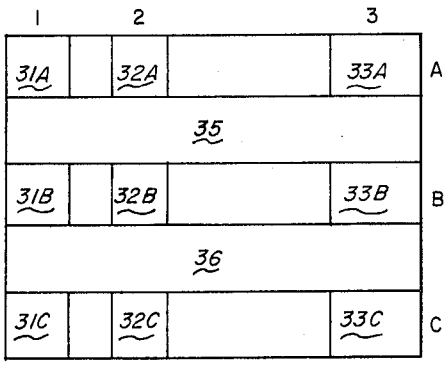
FIG. 3 is an auxiliary elevational view of the plane mirror array shown in FIG. 2.

Referring also now to FIG. 3, the plane mirror array is shown as comprising a matrix of rectangular or square reflective surfaces identified in FIG. 3 as surfaces 31A, 32A, 33A; 31B, 32B, 33B; and 31C, 32C, and 33C.

The areas intermediate these reflective surfaces are masked with a non-reflective material such as a non-reflective tape, and the areas 35 and 36 are preferably substantially open to permit passage through the array of incoming radiation from the object.

The rays 28A reflected from convex mirror 16 are parallel to the principal axis A1 and these rays are reflected from the reflective surfaces of the mirror array 20. The rays intercepted by the plane mirror array are reflected as rays 28B to the reflector surface of concave mirror 24. These rays are directed by mirror 24 to the focal point where sensing element 26 is disposed.

The arrangement shown in FIG. 2 essentially sections the field of view into nine discreet sector fields. Considering object 22 at position 1, and assuming that the object is positioned so that radiation is reflected from surface 32A, then a detection occurs at sensing element 26. As the object moves from position 1 to position 2 the sector field is left and at position 2 radiation through window 35 is directed to reflector surface 32B and a subsequent detection occurs at sensing element 26. Similarly, at position 3 the radiation is reflected from surface 32C and a detection also occurs then.

In FIG. 3 the movement in the direction 1—2—3 corresponds to tangential movement relative to the optical system causing sequential detection as the movement occurs. For example, tangential movement may be detected in sequence by reflections from surfaces 31B, 32B and 33B. Sequential detections also may occur by departing and re-entering the same sector field.

Figure 4:
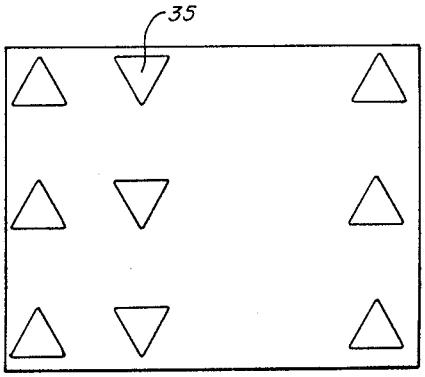
FIG. 4 is an alternate embodiment for the plane mirror array shown in FIG. 3.

FIG. 4 shows an alternate arrangement that can be substituted for the array of FIG. 3. In FIG. 4 there are shown nine reflective surfaces identified by the reference character 35. This arrangement ensures maximum change in energy when an intruder moves from the apex of the field of view of one mirror to the base of the field of view of the next mirror and vice versa.

The system shown in FIG. 2 thus collects divergent rays from the object to produce parallel rays 28A which are incident onto the plane mirror array 20 which is inclined at an angle to the principle axis A1 of the convex mirror 16. The parallel rays are then collected either by a concave or parabolic mirror and focused onto the detector 26. This system has a much larger field of view than the prior art systems and is capable of collecting much more radiation from an object. For example, an object having a length of two meters and disposed at 30 meters from the optical system has a one-third meter length in the field of view of the convex mirror. This is over 16 times more than is viewed by a concave mirror where the parallel rays are all brought to a point focus. However, because only convergent rays 28 produce parallel rays 28A this improvement in energy collection is somewhat reduced.

Figure 5:
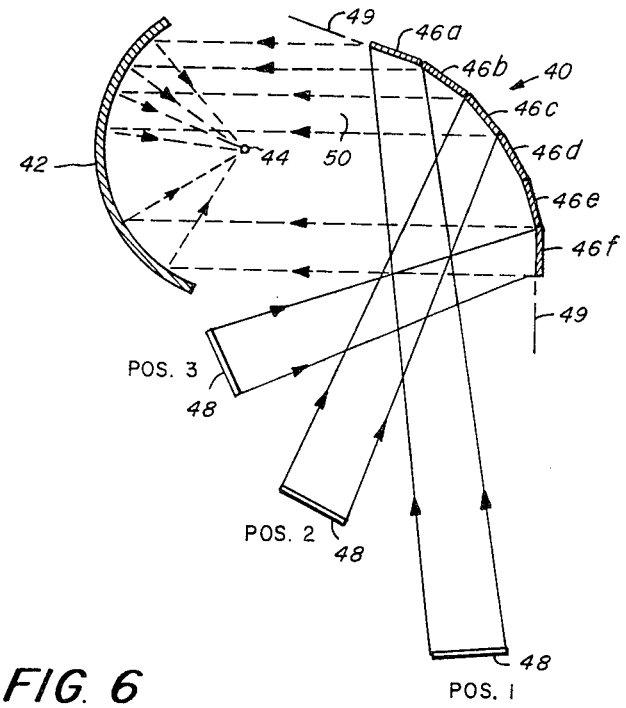
FIG. 5 shows another embodiment of an optical collecting system of the present invention.

FIG. 5 shows another optical arrangement of the present invention which is somewhat more simplified than the arrangement shown in FIG. 2. This system comprises an arcuate reflector member 40 which essentially replaces the convex mirror 16 and plane mirror array 20 shown in FIG. 2. The system of FIG. 5 also includes a parabolic or concave reflector 42 similar to the reflector 24 as shown in FIG. 2. A sensing element 44 is disposed at the focal point of reflector 42. The member 40 comprises a series of adjacent plane mirrors 46A, 46B, 46C, 46D, 46E, and 46F. The plane mirrors are disposed along an arcuate locus 49 in a manner so that all of the rays 50 reflected from these plane mirrors are directed in parallel to parabolic collector 42. Each mirror is disposed at an angle to its adjacent mirror as indicated in FIG. 5.

In FIG. 5 the object 48 is shown in three different positions and the rays emanating from the object are shown being reflected from respective plane mirror surfaces 46A, 46C, and 46F. As the object moves between the positions shown in FIG. 5 a chopping action is provided by the window space between each of the plane mirror surfaces.

Figure 6:
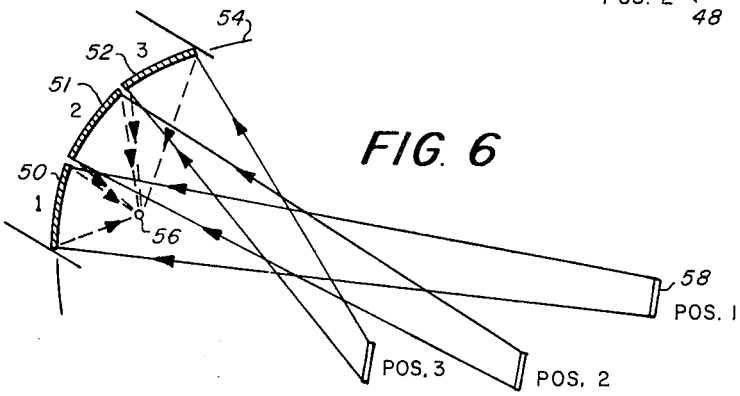
FIG. 6 shows still another optical system of the present invention.

FIG. 6 shows still another optical system of the present invention employing spherical or concave mirror segments 50, 51, and 52 which are disposed along a spherical locus 54. This arrangement structurally appears similar to the prior art arrangement shown in FIG. 1. However, the sensing element 56 is not disposed symmetrically as shown in FIG. 1 but is disposed asymmetrically closest to or at the focal point of mirror segment 50. The mirror 50 is disposed for receiving radiation from object 58 at the remote position 1. Because it is more difficult to detect radiation at a distance the sensor 56 is disposed more closely to reflective surface 50 so as to receive more radiation from distant objects and lesser radiation from closer objects wherein the attenuation of the radiation is less.

Figure 7:
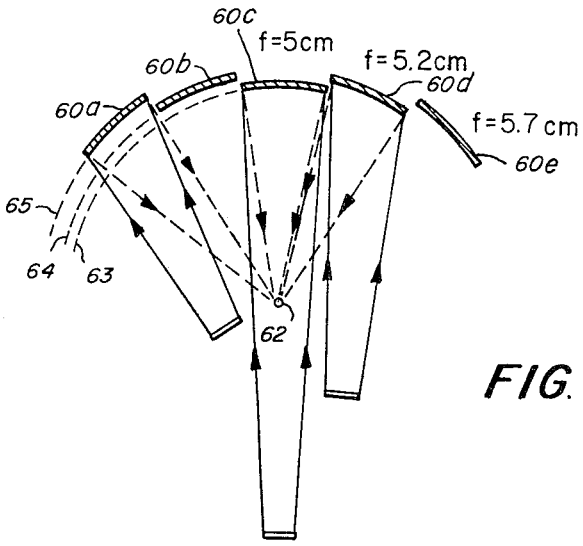
FIG. 7 shows still a further optical system of the present invention.

FIG. 7 shows still another optical arrangement of the present invention including spherical mirror segments 60A, 60B, 60C, 60D, and 60E arranged similarly to the mirror shown in FIG. 6. The sensing element 62 is disposed symmetrically in FIG. 7. However, the focal lengths of each of the mirror segments is different. The mirror segment 60C has the shortest focal length, mirrors 60B and 60D have somewhat longer focal lengths and mirrors 60A and 60E have still longer focal lengths. The mirror 60C is disposed at a first locus 63, the mirrors 60B and 60D are disposed at a second locus 64 and the outer mirror segments 60A and 60E are disposed at a locus 65.

Figure 8:
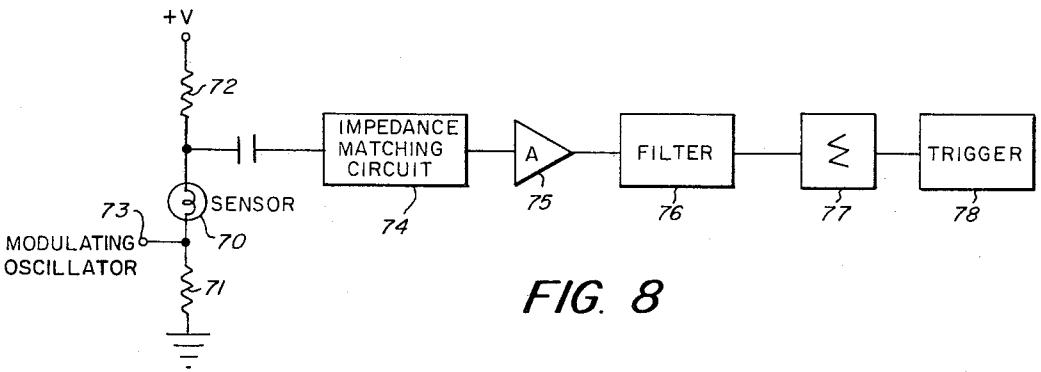
FIG. 8 is a partially block and partially circuit diagram of the detection circuit of the present invention.

FIG. 8 is a diagram partially in block form of a detection circuit in accordance with the present invention and which couples to a sensor 70. The sensor 70 is disclosed in FIG. 8 as a thermistor which has one side coupling through resistor 71 to ground and the other side coupling to bias element 72 which may be a resistor or another thermistor. Element 72 also couples to a supply V which is a stabilized regulated power supply. A modulating signal is coupled by way of input terminal 73 to the junction between resistor 71 and sensor 70. In one embodiment this modulating signal was a 15 hertz sinusoidal or squarewave signal.

The output of sensor 70 couples to matching circuit 74 and from there to amplifier 75. The output of amplifier 75 couples to a filter 76 which is a low frequency blocking filter for removing low frequency components in the frequency spectrum of one-half to two hertz. The output of filter 76 couples to a summing or integrating circuit 77 and from there to a trigger circuit 78 which preferably includes an alarm relay and associated audible or visible alarm means.

When sufficient energy is received by sensor 70, the amplifier 75 becomes saturated and the modulating frequency disappears or is shunted. When this signal is removed at the output of the amplifier the trigger circuit 78 is activated and an alarm condition prevails. Alternatively, when the sensor is not receiving energy the trigger circuit 78 is prevented from operating the alarm.

It can also be seen from the diagram of FIG. 8 that should the sensor 70 become a short circuit, for example, or an open circuit, the amplifier 75 saturates and an alarm condition exists. In this way, supervision of the circuit is readily obtained with this modulation technique.

One important feature of the present invention is the use of a thermistor for element 72. This thermistor is preferably selected to be similar in its characteristics to the sensor 70 and thus the element 72 functions as a temperature compensation element for maintaining a constant threshold voltage at the output of the sensor regardless of temperature fluctuations.

Figure 9:
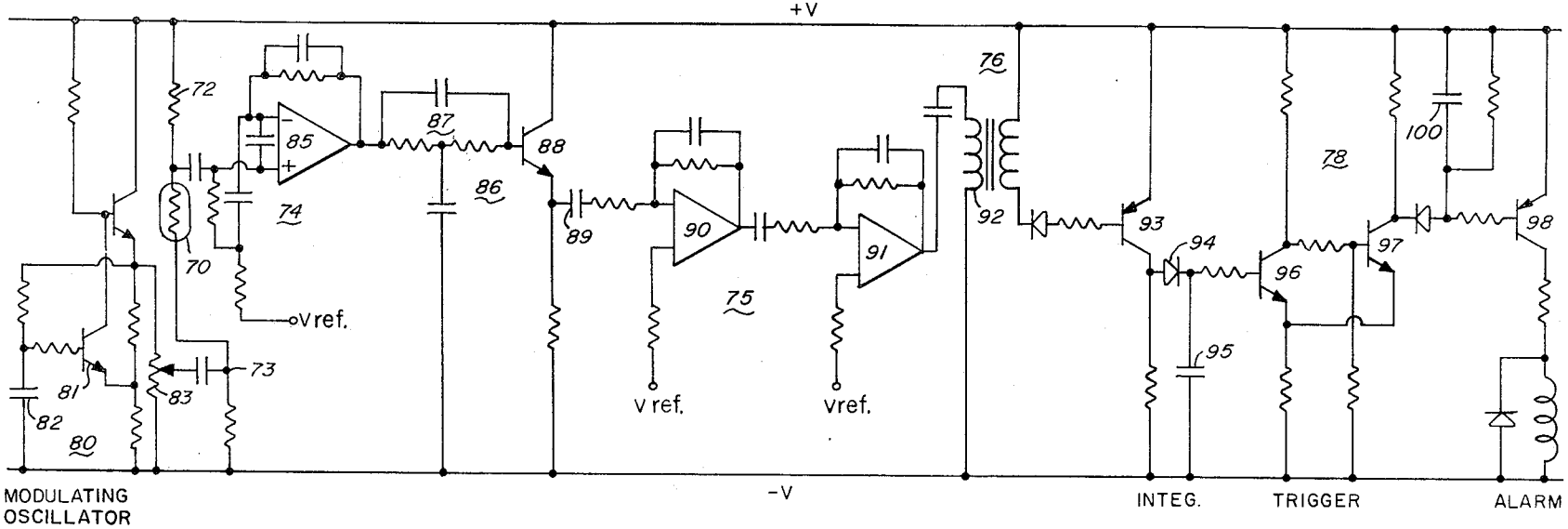
FIG. 9 is a detailed circuit diagram corresponding to the diagram shown in FIG. 8.

For a more thorough understanding of the operation of the diagram shown in FIG. 8, referecne is now made to a complete circuit diagram which is shown in FIG. 9 the modulating frequency coupled to input terminal 73 is from oscillator circuit 80 which is substantially a conventional relaxation oscillator circuit and generally includes transistor 81, timing capacitor 82, potentiometer 83, and associated biasing resistors. The components of the circuit are preselected so that the oscillator circuit 80 operates at a frequency of, for example, 15 hertz.

FIG. 9 also shows the sensor 70, resistor 71 and bias element 72 arranged in the same manner shown in FIG. 8. The sensor 70 and element 72 essentially comprise a voltage divider wherein the output voltage coupled to impedance matching circuit 74 is a function of the resistance of sensor 70 as controlled by the received radiation.

The impedance matching network 74 comprises basically an operational amplifier 85 and associated circuitry. The amplifier 85 has an extremely high input impedance and thus provides an impedance interface between the sensor 70 and the remainder of the detection circuitry. The output of operational amplifier 85 couples to a high frequency blocking circuit 86 which includes a bridged-T filter network 87 which is of conventional design. This filter network couples to a transistor 88 and the emitter of the transistor couples by way of capacitor 89 to the first stage of amplifier 75.

This first stage includes an operational amplifier 90 which couples to the second stage which includes a second operational amplifier 91. The filter circuit 86 is for blocking any high frequency signals typically in the range of 120 hertz or possibly higher in frequency.

The circuitry discussed to this point is designed so that when the sensor 70 is not detecting any radiation, the modulating signal at the input terminal 73 is passed unaffected to the output of operational amplifier 91. If the sensor 70 does detect radiation from a body the voltage coupled to amplifier 85 changes suddenly and the signal saturates amplifiers 90 and 91 thereby blocking the modulating signal to filter circuit 76.

The filter circuit 76 comprises a transformer 92 having a primary and secondary winding. The primary winding couples from the output of amplifier 75 and the secondary winding couples to integrator circuit 77. Transformer 92 functions as a low frequency blocking filter and also functions as a network for passing the modulating signal to the integrating circuit 77.

The integrating circuit 77 generally comprises transistor 93 diode 94 and integrating capacitor 95. When the modulating signal is present across the secondary of transformer 92 transistor 93 is periodically conducting and a charge path is provided by way of diode 94 to capacitor 95. When capacitor 95 is charged sufficiently this voltage is coupled to transistor 96 of trigger circuit 78. Transistor 96 is maintained in conduction and therefore transistor 97 is cut-off. Under this condition, the output alarm transistor 98 is also maintained cut-off and the alarm relay 99 is not energized.

Alternatively, if the modulating frequency is removed when a detection occurs transistor 93 ceases conduction, capacitor 95 discharges, transistor 96 turns off, and transistors 97 and 98 conduct causing energization of relay 99 thereby indicating an alarm condition. Capacitor 100 of the output circuit is a form of filter capacitor for providing some amount of time delay to prevent erroneous triggering.

In another embodiment, the alarm relay may be normally energized and is de-energized on receipt of an alarm signal.

Having described a limited number of embodiments of the present invention it should now become apparent that other embodiments and modifications thereof should fall within the spirit and scope of the present invention. For example, in FIG. 2 there is shown a preferred optical system of the present invention wherein the array of plane mirrors includes the masking for providing the chopping or modulating action. In an alternate embodiment the convex mirror could be provided with a non-reflective grid pattern instead of the planar array. In that case the planar array would be replaced by a single series of plane reflector surfaces. The series of plane mirrors extends in one direction covering one direction of motion and the convex mirror segments extend in the orthogonal direction covering an orthogonal direction of motion.

What is claimed is:

1. An infrared motion detecting intrusion detection system having a sensing element for receiving radiation, an oscillator, a bias element coupled in series with said sensing element to provide a voltage divider network with said sensing element, means coupling the oscillator signal to said sensing element to modulate the output signal from said sensing element at a predetermined modulating frequency, and means coupling from the output of said sensing element for passing said modulating frequency when no motion is sensed and for inhibiting said modulating frequency when motion is sensed.

2. In the system of claim 1, wherein said bias element includes a thermistor and said sensing element includes a thermistor. IR

3. In the system of claim 2, wherein both said thermistors have like temperature-voltage characteristics.

4. In the system of claim 1, wherein said means coupling from said sensing element includes a filter circuit for rejection low frequency signals below said modulating frequency.

5. The system of claim 4, further including impedance matching means and amplifier means coupled from the sensing element to the filter circuit, and trigger and alarm means coupled in succession from the filter circuit, said amplifier means having a saturated state when a detection occurs.

6. An infrared intrusion detection system comprising, a sensing element for receiving radiation the variations in intensity of which are to be detected as indicative of sensed motion, means for establishing a cyclic modulating signal to the sensing element to provide a modulated output signal from the sensing element, and circuit means coupling from the output of the sensing element for establishing an alarm condition when radiation is received by said sensing element comprising a low frequency stop band filter circuit including a transformer and means responsive to a first condition of said sensing element for passing the modulated output signal to the filter circuit and responsive to a second condition of said sensing element for blocking the modulated output signal.

7. The system of claim 6 wherein said circuit means comprises an input circuit which comprises an amplifier having an input coupled from the sensing element and an output coupled to the filter circuit, and an output alarm circuit which comprises a trigger circuit having an input coupled from the filter circuit.

8. A signal detection circuit comprising;

a sensor for receiving radiation the variations in intensity of which are to be detected as indicative of sensed motion, means for establishing a cyclic modulating signal of predetermined frequency, means coupling the modulating signal to the sensor to provide a modulated output signal from the sensor, and means coupling from the output of the sensor for passing the modulated output signal when the sensor is in a first condition corresponding to a first level of radiation and blocking the modulated signal when the sensor is in a second condition corresponding to a second level of radiation.

9. A signal detection circuit as set forth in claim 8 wherein said means coupling from the sensor includes amplifier means that is saturated to block the modulated signal in the second state of the sensor.

10. A signal detection circuit as set forth in claim 9 wherein said sensor in its first condition receives substantially no radiation and receives radiation in its second condition indicative of sensed motion.

11. A signal detection circuit as set forth in claim 10 including a bias element coupled in series with the sensor to provide a voltage divider network.

12. A signal detection circuit as set forth in claim 11 wherein said bias element comprises a thermistor and said sensor comprises a thermistor, both said thermistors having like temperature-voltage characteristics.

13. A signal detection circuit as set forth in claim 8 wherein said sensor comprises a heat responsive resistive element.

14. A signal detection circuit as set forth in claim 13 including a bias element comprising a resistive element and means coupling the heat responsive resistive element and resistive element in series to form a voltage divider network.

15. A signal detection circuit as set forth in claim 14 including a resistor in series with said sensor with the modulating signal being coupled to the node defined between the sensor and resistor.

16. A signal detection circuit as set forth in claim 14 wherein said bias element comprises a heat responsive resistive element having substantially the same temperature-voltage characteristics as the heat responsive resistive element of the sensor.

17. An infrared motion detecting system comprising a sensing element responsive to received radiation, means for biasing the sensing element so that it is operative, means establishing an alternating signal, and means coupling the alternating signal to the sensing element to modulate the output signal therefrom.

* * * * *